United States Patent [19]

Ishikawa et al.

[11] Patent Number: 4,469,781

[45] Date of Patent: Sep. 4, 1984

[54] PROCESSING FOR SILVER HALIDE COLOR PHOTOGRAPHIC MATERIALS

[75] Inventors: Takatoshi Ishikawa; Takashi Nakamura, both of Kanagawa, Japan

[73] Assignee: Fuji Photo Film Co., Ltd., Kanagawa, Japan

[21] Appl. No.: 438,185

[22] Filed: Nov. 1, 1982

[30] Foreign Application Priority Data

Oct. 30, 1981 [JP] Japan ..... 56-173950

[51] Int. Cl.[3] ..... G03C 7/00

[52] U.S. Cl. ..... 430/393; 430/455; 430/460; 430/461

[58] Field of Search ..... 430/393, 455, 460, 461

[56] References Cited

U.S. PATENT DOCUMENTS

| | | | |
|---|---|---|---|
| 3,879,202 | 4/1975 | Yamaguchi | 430/393 |
| 3,948,659 | 4/1976 | Yamaguchi et al. | 430/393 |
| 4,040,838 | 8/1977 | Yamaguchi | 430/393 |
| 4,366,233 | 12/1982 | Nakamura | 430/393 |

*Primary Examiner*—J. Travis Brown

*Attorney, Agent, or Firm*—Sughrue, Mion, Zinn, Macpeak & Seas

[57] ABSTRACT

The disclosed invention is a means for preventing the reduction of color density caused by the formation of leuco compounds from cyan dyes when processing color photographic materials with a bleach solution or a blix solution containing benzyl alcohol. The invention involves incorporating the compound shown by the following formula (I) in the bleach solution or blix solution:

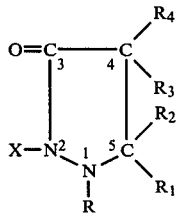

(I)

wherein X represents a hydrogen atom or an acetyl group; R represents an aryl group; and $R_1$, $R_2$, $R_3$ and $R_4$, which may be the same or different, each represents a hydrogen atom, an alkyl group or an aryl group.

6 Claims, No Drawings

PROCESSING FOR SILVER HALIDE COLOR PHOTOGRAPHIC MATERIALS

FIELD OF THE INVENTION

This invention relates to a method for processing silver halide color photographic materials and, more particularly, to a method for processing silver halide color photographic materials capable of preventing the conversion of colored dyes into leuco materials and the formation of color fog.

BACKGROUND OF THE INVENTION

In processing for silver halide color photographic materials, after image-exposure, the color photographic materials are usually developed by a color developer containing an aromatic primary amine color developing agent. During this processing the silver halide is reduced to form developed silver and at the same time the color developing agent itself is oxidized, which then reacts with a coupler to form an intermediate (leuco compound) of the colored dye. Thereafter, developed silver is rehalogenized by a bleach solution and removed by a fix solution or is oxidized and removed by a blix solution. Also, the colorless leuco compound is oxidized by a bleaching agent in the bleach solution or the blix solution to form a colored dye.

Recently, speed up of processing is required to improve the producibility and reduce the processing cost and, thus, a color development is performed without employing a stop bath between a color development bath and a bleach bath or a blix bath and further, as the case may be, a wash bath is also omitted. Hence the light-sensitive materials are frequently processed in a bleach solution or a blix solution in the state of insufficient washing out of the color developing agent from the light-insensitive materials.

Furthemore, recently, reduction of the using amount of a bleach solution or a blix solution as well as reduction of the discharging amount thereof are required from the viewpoints of the reduction in cost and the regulation of pollution. Hence, a method is proposed wherein the amount of a supplementing solution is reduced or the overflowed solution is recovered and reused (Japanese Patent Publication No. 33697/81 (corresponding to U.S. Pat. No. 3,707,568)). In such a case, the components of the color developer carried in a bleach solution or a blix solution are accumulated therein, and a color developing agent of the accumulated color developer is liable to be oxidized by a bleaching agent and react with a remaining coupler to cause color fog. Also, when a bleaching agent does not show a sufficient oxidizing power due to the occurrence of fatigue, etc., a part of the leuco compound is not converted into a colored dye but remains as the leuco compound, thereby a sufficient color density cannot be obtained.

In particular, when performing blix processing, since the oxidizing power of a bleaching agent is relatively weak, the leuco compound is reluctant to become a colored dye or a colored dye is reduced to form a leuco compound by the reducing agent carried in the blix solution from a color developer or by the reducing agent in the blix solution to reduce the color density. Accordingly, sufficient color reproduction cannot be obtained. Such a phenomenon is particularly remarkable in the case of a cyan dye. That is, a cyan dye is liable to become a leuco compound which results in great reduction of color density.

The present inventors have carried out investigations and confirmed that when benzyl alcohol contained in a color developer is largely accumulated in a bleach solution or blix solution as the results of reducing the supplementing amount of a bleach solution or blix solution or reutilizing an overflowed solution, washing out of color development components from color photographic materials is delayed. This causes substantial formations of color stains and leuco compounds. Thus, it becomes necessary to investigate a method of preventing the formation of leuco compounds and color stains from a viewpoint different from conventional methods.

A known method for preventing the formation of color stains involves adding a p-aminophenol to a bleach solution or a blix solution as described in British Pat. No. 1,133,500. Another known method involves adding an amine to a bleach solution containing persulfuric acid as described in U.S. Pat. No. 3,707,347. However, when these methods are used, color turbidity occurs or the effect of preventing the formation of color stain is insufficient.

British Pat. No. 1,132,339 describes a method of adding a 3-pyrazolidone to a bleach solution or a blix solution. However, the method does not take into consideration the fact that the bleach solution or blix solution forms a substantial amount of leuco compounds with benzyl alcohol contained therein at a high concentration.

Various methods for preventing the formation of leuco compounds have been investigated. For example, as an improvement for processing solution, there is provided a processing method of separately forming an oxidizing bath containing a material having a strong bleaching power, such as a ferricyanide, a dichromate or a ferric salt. However, the use of such a compound is undesirable with respect to both obstructing the speed up of processing and environmental contamination. Another method provides for increasing the concentration of an aminopolycarboxylic acid iron salt as a bleaching agent as described in Japanese Patent Application (OPI) Nos. 3340/71 (corresponding to U.S. Pat. No. 3,706,561) and 5630/74 (corresponding to British Pat. No. 1,393,335) (the term "OPI" as used herein refers to a "published unexamined Japanese patent application). However, such a method is not always preferred since the cost for processing becomes high and further the stability of the processing solution is reduced.

Another known method involves adding a compound such as ethylene oxide, a mercapto compound, a p-aminophenolic compound, and amine series compound, etc., to a bleach solution or a blix solution. However, this method is still unsatisfactory since color turbidity occurs and the effect of preventing the forming of leuco compounds is less.

Other known methods of improving color photographic materials include a method of using fluorine series cyan couplers as described in Japanese Patent Application (OPI) Nos. 137137/75 and 65953/80, a method of using an organic acid ester as an oil for emulsification as described in Japanese Patent Application (OPI) No. 52533/79 and Japanese Patent Publication No. 2335/81, and a method of incorporating paraffin in a red-sensitive silver halide emulsion layer and/or a layer adjacent to the emulsion layer as described in Japanese Patent Application (OPI) No. 99432/79. However. these methods are unsatisfactory because development is delayed and the effect of preventing the formation of leuco compounds is less.

SUMMARY OF THE INVENTION

A primary object of this invention is to provide a method of processing silver halide color photographic materials capable of preventing the formation of leuco compounds when a bleach solution or a blix solution contains benzyl alcohol.

Another object of this invention is to provide a method of processing silver halide color photographic materials which is capable of preventing the formation of color stain.

As the result of various investigations, the inventors have discovered that the foregoing objects of this invention can be effectively attained, in a method of developing, bleaching and fixing silver halide color photographic materials, by incorporating at least one compound represented by the following general formula (I) in a bleach solution or a blix solution containing benzyl alcohol:

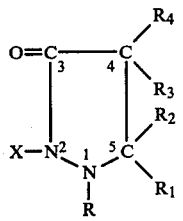

(I)

wherein X represents a hydrogen atom or an acetyl group; R represents an aryl group; and $R_1$, $R_2$, $R_3$ and $R_4$, which may be the same or different, each represents a hydrogen atom, an alkyl group, or an aryl group.

DETAILED DESCRIPTION OF THE INVENTION

The benzyl alcohol is contained in a bleach solution or blix solution in an amount of such a high concentration extent that the washing out speed of color developer components from photographic materials is delayed and color stains or leuco compounds can form. The benzyl alcohol may be present in an amount of about 0.1 to 30 ml/l, preferably 1.0 to 15 ml/l, more preferably 3.0 to 10.0 ml/l.

The acetyl group shown by X in general formula (I) may be substituted by, for example, an alkyl group having 1 to 4 carbon atoms such as a methyl group or an ethyl group. However, X is preferably a hydrogen atom.

Examples of the aryl group shown by R in general formula (I) include a phenyl group, a naphthyl group, a tolyl group and a xylyl group. However, R is preferably a phenyl group. These groups may be substituted by, for example, a halogen atom (e.g., chlorine atom, bromine atom, etc.), an alkyl group having 1 to 10 carbon atoms (e.g., methyl group, ethyl group, propyl group, etc.), an alkoxy group having 1 to 10 carbon atoms (e.g., methoxy group, ethoxy group, etc.), a sulfonyl group, or an amido group having 1 to 10 carbon atoms (e.g., methylamido group, ethylamido group, etc.).

Preferred examples of the alkyl group shown by $R_1$, $R_2$, $R_3$ and $R_4$ in general formula (I) are alkyl groups having 1 to 10 carbon atoms, such as a methyl group, an ethyl group, a propyl group, a butyl group, etc. These alkyl groups may be substituted by a hydroxy group, an amino group, an acyloxy group, etc.

Examples of the aryl group shown by $R_1$, $R_2$, $R_3$ and $R_4$ include a phenyl group, a naphthyl group, a xylyl group and a tolyl group. However, a phenyl group is preferred. These groups may be substituted by a halogen atom (e.g., chlorine atom, bromine atom, etc.), an alkyl group (e.g., methyl group, ethyl group, propyl group, etc.), an alkoxy group (e.g., methoxy group, ethoxy group, etc.), or a hydroxy group.

In accordance with the present invention, $R_1$, $R_2$, $R_3$ and $R_4$ in general formula (I) are preferably a hydrogen atom, an alkyl group having 1 to 3 carbon atoms, or a substituted alkyl group where the alkyl moiety has 1 to 3 carbon atoms, and particularly preferably a hydrogen atom, a methyl group, a hydroxymethyl group, or a hydroxyethyl group.

Preferred compounds represented by general formula (I) include 3-pyrazolidones, practical examples of which are as follows:

(I)-1. 1-phenyl-3-pyrazolidone
(I)-2. 1-phenyl-4,4-dimethyl-3-pyrazolidone
(I)-3. 1-o-tolyl-4,4-dimethyl-3-pyrazolidone
(I)-4. 4-hydroxymethyl-4-methyl-1-phenyl-3-pyrazolidone
(I)-5. 1-m-tolyl-3-pyrazolidone
(I)-6. 1-p-tolyl-3-pyrazolidone
(I)-7. 1-phenyl-4-methyl-3-pyrazolidone
(I)-8. 1-phenyl-5-methyl-3-pyrazolidone
(I)-9. 1-phenyl-4,4-bis(hydroxymethyl)-3-pyrazolidone
(I)-10. 1,5-diphenyl-4-methyl-3-pyrazolidone
(I)-11. 1-p-tolyl-4-methyl-5-phenyl-3-pyrazolidone
(I)-12. 1-phenyl-5-p-tolyl-3-pyrazolidone
(I)-13. 1-(3-chlorophenyl)-4-methyl-3-pyrazolidone
(I)-14. 1-(3-chlorophenyl)-3-pyrazolidone
(I)-15. 1-p-tolyl-4-methyl-3-pyrazolidone
(I)-16. 1-p-tolyl-4,4-dimethyl-3-pyrazolidone
(I)-17. 1-o-tolyl-4-methyl-3-pyrazolidone
(I)-18. 1-m-tolyl-4,4-bis(hydroxymethyl)-3-pyrazolidone
(I)-19. 1-m-tolyl-4,4-dimethyl-3-pyrazolidone
(I)-20. 1-(2-trifluoroethyl)-4,4-dimethyl-3-pyrazolidone
(I)-21. 1-phenyl-4,4,5,5-tetramethyl-3-pyrazolidone
(I)-22. 1,5-diphenyl-3-pyrazolidone
(I)-23. 1-phenyl-5,5-dimethyl-3-pyrazolidone
(I)-24. 1,5-diphenyl-4-hydroxymethyl-3-pyrazolidone
(I)-25. 1-o-tolyl-4,4-bis(hydroxymethyl)-3-pyrazolidone
(I)-26. 1-(2-chlorophenyl)-4-hydroxymethyl-4-methyl-3-pyrazolidone
(I)-27. 1-p-tolyl-4-hydroxymethyl-4-methyl-3-pyrazolidone
(I)-28. 1-(4-chlorophenyl)-4-hydroxymethyl-4-methyl-3-pyrazolidone
(I)-29. 1-phenyl-2-acetyl-3-pyrazolidone In the foregoing typical examples of the compounds shown by general formula (I), Compounds (I)-1, (I)-4, (I)-9, (I)-25, (I)-26, (I)-27 and (I)-28 are particularly preferred in this invention.

The compound represented by formula (I) is generally present in an amount of 0.1 to 5.0 g, preferably 0.1 to 1.0 g per liter of a bleach solution or a blix solution.

The color developer used in this invention may contain a primary aromatic amine developing agent as a color developing agent. Specific examples of useful agents include phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline).

Furthermore, it is possible to use the color developing agents described in L. F. A. Mason, *Photographic Processing Chemistry,* pages 226–229 (1966), published by Focal Press, U.S. Pat. Nos. 2,193,015 and 2,592,364 (incorporated herein by reference to disclose such agents), and Japanese Patent Application (OPI) No. 64933/73 (corresponding to U.S. Pat. Nos. 3,816,134 and 3,907,875).

Color photographic materials processed by the method of this invention may contain therein color developing agents. For example, color photographic materials may contain color developing agents in the form of a precursor or complex salt thereof as described in U.S. Pat. Nos. 2,478,400, 3,342,597, 3,342,599, 3,719,492 and 4,214,047, Japanese Patent Application (OPI) Nos. 135628/78 (corresponding to U.S. Pat. No. 4,157,915), 79035/79, 6235/81 (corresponding to U.S. Pat. No. 4,297,441), 54430/81 (corresponding to British Pat. 2,064,149) and 89735/81, and *Research Disclosure,* Nos. 13924, 14850 and 15159. In this case, the color photographic materials can be processed by an alkaline bath in place of a color developing bath and thereafter processed by a bleach solution or a blix solution according to this invention.

The processing temperature used with the color developer or the alkaline solution is in an ordinary range and is preferably in the range of 28° to 40° C.

The color developer or alkaline solution may further contain a pH buffer such as an alkali metal sulfite, carbonate, borate, or phosphate and a development inhibitor or an antifoggant such as a bromide, an iodide and an organic antifoggant. The color developer or alkaline solution may also contain, if desired, a water softener; a preservative such as hydroxylamine, etc.; a development accelerator such as polyethylene glycol, a quaternary ammonium salt, an amine, etc.; a dye-forming coupler; a competing coupler; a tackifier; the polycarboxylic acid series chelating agent described in U.S. Pat. No. 4,083,723; and the antioxidant described in West German Patent Application (OLS) No. 2,622,950.

In the bleach solution or blix solution used in this invention, it is preferred that the supplementing amount is reduced or that the overflowed solution is reutilized and if it is necessary the bleach solution or blix solution contain benzyl alcohol in an amount of 0.1 to 30 ml/l, preferably 1.0 to 1.5 ml/l, more preferably 3.0 to 10.0 ml/l. The term "the supplementing amount is reduced" that the supplemental solution is supplemented in an amount of 30 to 300 ml, preferably 30 to 100 ml per square meter of a color photographic material. The term "overflowed solution" is a solution overflowed from a processing tank when a bleach solution or blix solution is supplemented. For regenerating and reutilizing the overflowed solution, the methods described in Japanese Patent Application (OPI) Nos. 781/71, 49437/73, 18191/73, 145231/75, 18541/76, 19535/76 and 144620/76 and Japanese Patent Publication No. 23178/76 can be used.

Examples of bleaching agent used in this invention include compounds of polyvalent metals such as iron (III), cobalt (III), chromium (VI), copper (II), etc.; peracids; quinones; nitroso compounds; etc. For example, ferricyanides, dichromates, organic complex salts of iron (III) or cobalt (III), aminopolycarboxylic acids (e.g., ethylenediaminetetraacetic acid, nitrotriacetic acid, 1,3-diamino-2-propanoltetraacetic acid, etc.), complex salts of an organic acid (e.g., citric acid, tartaric acid, malic acid, etc.), persulfates, permanganates, nitrosophenol, etc., can be used. With respect to these compounds, ethylenediaminetetraacetic acid iron (III) sodium salt and ethylenediaminetetraacetic acid iron (III) ammonium salt are particularly useful and a blix solution containing such a salt is particularly preferred as used in connection with this invention.

The bleach solution or blix solution used in this invention can further contain the bleaching accelerators described in U.S. Pat. Nos. 3,042,520 and 3,241,966 and Japanese Patent Publication Nos. 8836/70 and 8506/70; the thiol compounds described in Japanese Patent Application (OPI) No. 65732/78; and other various additives.

In this invention, color photographic materials may be processed by the developer supplemented or managed by the method as described in Japanese Patent Application (OPI) Nos. 84636/76, 119934/77, 46732/78, 9626/79, 19741/79 and 37731/79, U.S. Pat. Nos. 4,313,808, U.S. patent application Ser. No. 159,565 (filed June 16, 1980) and Japanese Patent Application (OPI) No. 27412/81.

Color photographic materials processed by color development, such as color photographic papers, color negative photographic films, color photographic reversal films, etc., can be processed in connection with this invention. However, the improved results are particularly noticeable with color photographic papers.

Silver halide photographic emulsions used in connection with this invention are prepared by the methods described in P. Glafkides, *Chimie et Physique Photographique,* published by Paul Montel, 1967, G. F. Duffin, *Photographic Emulsion Chemistry,* published by The Focal Press, 1966, and V. L. Zelikman et al., *Making and Coating Photographic Emulsion,* published by The Focal Press, 1964. The photographic emulsions may be prepared by an acid method, a neutralization method or an ammonia method. The method used for reacting a soluble silver salt and a soluble halide may be a one side mixing method, a simultaneous mixing method, or a combination of them. It is also possible to use a method of forming silver halide grains in the presence of excessive silver ions (so-called back mixing method).

An example of a system of the simultaneous mixing method is the so-called controlled double jet method, that is a method of maintaining constant the pAg in the liquid wherein silver halide is formed.

Silver halides used with the photographic silver halide emulsions in connection with this invention include silver bromide, silver iodobromide, silver iodochlorobromide, silver chlorobromide, and silver chloride.

The formation or physical ripening for silver halide grains may be performed in the presence of a cadmium salt, zinc salt, lead salt, thallium salt, iridium salt or a complex salt thereof, rhodium salt or a complex salt thereof, iron salt or a complex salt thereof, etc.

The photographic silver halide emulsions used in this invention may be spectrally sensitized by methine dyes or other dyes. Examples of dyes used for this purpose include cyanine dyes, merocyanine dyes, composite cyanine dyes, composite merocyanine dyes, holopolar cyanine dyes, hemicyanine dyes, styryl dyes, and hemioxonol dyes. Particularly useful dyes are those belonging to cyanine dyes, merocyanine dyes, and composite merocyanine dyes. To these dyes are applied nuclei usually utilized for cyanine dyes as basic heterocyclic nuclei.

Useful sensitizing dyes are described in, for example, German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, and Japanese Patent Publication Nos. 14030/69 and 24844/77.

These sensitizing dyes may be used solely or as a combination of them and a combination of sensitizing dyes is frequently used for the purpose of supersentization. Typical examples of them are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68 and 12375/78, and Japanese Patent Application (OPI) Nos. 110618/77 and 109925/77.

A dye having no spectral sensitizing action by itself or a material which does not substantially absorb visible light and shows supersensitization may be incorporated in the silver halide emulsion together with the sensitizing dye or dyes. For example, the silver halide emulsions may contain aminostilbene compounds substituted by a nitrogen-containing heterocyclic group (described in, for example, U.S. Pat. Nos. 2,933,390 and 3,635,721), aromatic organic formaldehyde condensates (described in, for example, U.S. Pat. No. 3,743,510), cadmium salts or azaindene compounds. The combinations described in U.S. Pat. Nos. 3,615,613, 3,615,641, 3,617,295 and 3,635,721 are particularly useful.

Gelatin is advantageously used as a binder or protective colloid for photographic silver halide emulsions. However, other hydrophilic colloids may be used.

Examples of such colloids include gelatin derivatives; graft polymers of gelatin and other polymers; proteins such as albumin, casein, etc.; cellulose derivatives such as hydroxyethyl cellulose, carboxymethyl cellulose, cellulose sulfuric acid ester, etc.; sugar derivatives such as sodium alginate; starch derivatives; and various synthetic hydrophilic homo- or copolymers of polyvinyl alcohol, partial acetal of polyvinyl alcohol, poly-N-vinylpyrrolidone, polyacrylic acid, polymethacrylic acid, polyacrylamide, polyvinyl imidazole or polyvinyl pyrazol.

Typical synthetic hydrophilic polymers are described in, for example, West German Patent Application (OLS) No. 2,312,708, U.S. Pat. No. 3,620,751 and 2,879,205, and Japanese Patent Publication No. 7561/68.

This invention can be applied to a multilayer multicolor photographic material having at least two layers having different spectral sensitivities on a support. A multilayer natural color photographic material has at least one red-sensitive emulsion layer, at least one green-sensitive emulsion layer and at least one blue-sensitive emulsion layer on a support. The disposition order of these layers may be selected according to particular requirements. Usually, the red-sensitive emulsion layer contains a cyan-forming coupler, the green-sensitive emulsion layer contains a magenta-forming coupler, and the blue-sensitive emulsion layer contains a yellow-forming coupler, but as the case may be, different combinations may be employed.

The photographic materials used in connection with this invention may contain water-soluble dyes as filter dyes or for irradiation prevention or other purposes in the hydrophilic colloid layers. Examples of such water-soluble dyes include oxonal dyes, hemioxonol dyes, styryl dyes, merocyanine dyes, cyanine dyes, and azo dyes. Practical examples of these dyes which may be used in connection with this invention are described in British Patents 584,609 and 1,177,429, Japanese Patent Application (OPI) Nos. 85130/73, 99620/74, 114420/74 and 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312, and 4,070,352.

The photographic material used in this invention may contain a known image dye stabilizer. The image dye stabilizers used in this invention can be used solely or as a combination of two or more. Examples of useful image dye stabilizers include the hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc.; the gallic acid derivative described in U.S. Pat. Nos. 3,457,079 and 3,069,262; the p-alkoxyphenols described in U.S. Pat. Nos. 2,735,765 and 3,698,909, Japanese Patent Publication Nos. 20977/74 and 6623/77; the p-oxyphenol derivatives described in U.S. Pat. Nos. 3,432,300, 3,573,050, 3,574,627 and 3,764,337, and Japanese Patent Application (OPI) Nos. 35633/77, 147434/77 and 152225/77; and the bisphenols described in U.S. Pat. No. 3,700,455.

The photographic materials used in this invention may contain ultraviolet absorbents in the hydrophilic colloid layers. Examples of such ultraviolet absorbents include benzotriazole compounds substituted by an aryl group (described in, e.g., U.S. Pat. No. 3,533,794), 4-thiazolidone compounds (described in, for example, U.S. Pat. Nos. 3,314,794 and 3,352,681), benzophenone compounds (described in, for example, Japanese Patent Application (OPI) No. 2784/71), cinnamic acid ester compounds (described in, for example, U.S. Pat. Nos. 3,705,805 and 3,707,375), butadiene compounds (described in, for example, U.S. Pat. No. 4,045,229), and benzoxazole compounds (described in, for example, U.S. Pat. No. 3,700,455). Furthermore, the ultraviolet absorbents described in U.S. Pat. No. 3,499,762 and Japanese Patent Application (OPI) No. 48535/79 can be used. Ultraviolet absorbing couplers (for example, α-naphthol series cyan dye-forming couplers) and ultraviolet absorbing polymers may be used. These ultraviolet absorbents may be mordanted to specific layers.

The photographic materials used in this invention may contain stilbene series, triazine series, oxazole series, or cumarine series whitening agents in the silver halide photographic emulsion layers or other hydrophilic colloid layers. These whitening agents may be water-soluble or may be water-insoluble and in the latter case they are used as the form of dispersions. Practical examples of optical whitening agents are described in U.S. Pat. Nos. 2,632,701, 3,269,840, 3,359,102 and British Pat. Nos. 852,075 and 1,319,763.

The photographic silver halide emulsion layers of the photographic materials used in this invention contain couplers capable of coloring by causing oxidative coupling with an aromatic primary amine developing agent (e.g., a phenylenediamine derivative or an aminophenol derivative) during color development processing.

Examples of magenta couplers used in connection with this invention include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78 and 35858/82.

Examples of yellow couplers used in connection with this invention include benzoylacetanilide series compounds and pivaloylacetonitrile series compounds. Practical examples of the yellow couplers are described in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, and 115219/77.

Examples of cyan couplers used in connection with this invention include phenol series compounds and naphthol series compounds. Practical examples are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77 and 90932/77.

These cyan couplers are generally more likely to become leuco compounds as compared with yellow couplers and magenta couplers, and cyan couplers which are prevented from becoming leuco compounds have not yet been sufficiently developed.

Examples of colored couplers used in this invention are described in, for example, U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 4212177, and West German Patent Application (OLS) No. 2,418,959.

Examples of DIR couplers used in connection with this invention include couplers described in, for example, U.S. Pat. Nos. 3,227,554, 3,617,291, 3,701,783, 3,790,384 and 3,632,345, West German Patent Application (OLS) Nos. 2,414,006, 2,454,301 and 2,454,329, British Pat. No. 953,454, Japanese Patent Application (OPI) Nos. 69624/77 and 122335/74, and Japanese Patent Publication No. 16141/76.

In place of DIR couplers, compounds which release development inhibitors by development may be incorporated in the photographic materials used in connection with this invention and examples of such compounds are described in, for example, U.S. Pat. Nos. 3,297,445 and 3,379,529, West German Patent Application (OLS) No. 2,417,914, and Japanese Patent Application (OPI) Nos. 15271/77 and 9116/78.

The foregoing couplers may be incorporated in the same layer as a mixture of two or more couplers or the same coupler may be incorporated in two or more different layers.

These couplers are incorporated in silver halide emulsion layers generally in an amount of $2\times10^{-3}$ mole to $5\times10^{-1}$ mole, preferably $1\times10^{-2}$ mole to $5\times10^{-1}$ mole per mole of silver in the silver halide emulsion layer.

EXAMPLE 1

On a polyethylene-laminated paper support was coated a dispersion in a blue-sensitive silver chlorobromide emulsion (80 mole% silver bromide) a solution of α-pivaloyl-4-(4-benzyloxyphenylsulfonyl)phenoxy-2-chloro-5-[γ-(2,4-di-t-amylphenoxy)butyramido]acetanilide (yellow coupler) dissolved in dioctylbutyl phosphate (silver coverage of 0.40 g/m$^2$, coupler coverage of $8\times10^{-4}$ mole/m$^2$, coupler oil coverage of 0.3 g/m$^2$, and gelatin coverage of 1.4 g/m$^2$). Then, a gelatin interlayer containing di-t-octylhydroquinone in an amount of 50 mg/m$^2$ was coated on the blue-sensitive emulsion layer (gelatin coverage of 1.0 g/m$^2$). A mixture of a solution of 1-(2,4,6-trichlorophenyl)-3-{5-[α-(3-t-butyl-4-hydroxyphenoxy)tetradecanamido]-2-chloroanilino}-5-pyrazolone (magenta coupler) with a green-sensitive silver chlorobromide emulsion (60 mole% silver bromide) was coated on the interlayer (silver coverage of 0.40 g/m$^2$, coupler amount of $5.8\times10^{-4}$ mole/m$^2$, coupler oil coverage of 0.35 g/m$^2$, and gelatin coverage of 1.5 g/m$^2$). A gelatin interlayer containing 50 mg/m$^2$ of di-t-octylhydroquinone was coated on the green-sensitive emulsion layer (gelatin coverage of 1.5 g/m$^2$). A mixture of a solution of 2-[α-(2,4-di-t-amylphenoxy)-butyramido]-4,6-dichloro-5-methylphenol (cyan coupler) dissolved in dibutyl phthalate with a red-sensitive silver chlorobromide emulsion (50 mole% silver bromide) was coated on the gelatin interlayer (silver coverage of 0.3 g/m$^2$, coupler coverage of $8.5\times10^{-4}$ mole/m$^2$, coupler oil coverage of 0.2 g/m$^2$, and gelatin coverage of 1.0 g/m$^2$). Finally, a gelatin protective layer (1 g/m$^2$) was coated on the red-sensitive emulsion layer to provide a photographic material (A).

After exposing the material through an optical wedge, the photographic material (A) was processed by the following steps (processing I).

Processing Step (33° C.)

| | |
|---|---|
| Color development | 3 min 30 sec |
| Blix | 1 min 30 sec |
| Wash | 3 min |
| Drying | 10 min |

The compositions of the processing solutions used in the above processing steps were as follows.

Color Developer:

| | |
|---|---|
| Benzyl alcohol | 15 ml |
| Diethylene glycol | 5 ml |
| Potassium carbonate | 25 g |
| Sodium chloride | 0.1 g |
| Sodium bromide | 0.5 g |
| Anhydrous sodium sulfite | 2 g |
| Hydroxylamine sulfate | 2 g |
| N—Ethyl-N—β-methanesulfonamidoethyl 3-methyl-4-aminoaniline sulfate | 4 g |
| Water to make | 1 l |
| pH adjusted to 10 by the addition of NaOH | |

Blix Solution:

| | |
|---|---|
| Ammonium thiosulfate | 124.5 g |
| Sodium metahydrogensulfite | 13.3 g |
| Anhydrous sodium sulfite | 3.0 g |

-continued

| | |
|---|---|
| Ethylenediaminetetraacetic acid ferric ammonium salt | 65 g |
| Color developer (as described above, omitting, however, benzyl alcohol) | 100 ml |
| Water to make | 1 l |
| pH adjusted to 6.7 to 6.8 | |

Color developer was contained in the foregoing blix solution because experimentally, when the processing was continued in the foregoing processing steps, about 10% of the color developer remained.

The maximum density of a cyan dye easily forming leuco compound was measured by means of a Macbeth densitometer. Similarly, when the blix solution contained benzyl alcohol, the maximum density of cyan when Compound (I)-4 was added to the blix solution was measured. The results are shown in Table 1.

TABLE 1

| Concentration of Benzyl Alcohol (ml/l) | Compound (I)-4 (mg/l) | Maximum Density |
|---|---|---|
| 0 | 0 | 2.20 |
| 2.5 | 0 | 2.01 |
| 5.0 | 0 | 1.95 |
| 7.5 | 0 | 1.89 |
| 0 | 412 | 2.51 |
| 2.5 | 412 | 2.60 |
| 5.0 | 412 | 2.62 |
| 7.5 | 412 | 2.63 |

The results in Table 1 clearly show that when a blix solution contains benzyl alcohol, the density reduction of cyan dye by the formation of leuco compound is particularly remarkable. Furthermore, the results show that the density reduction is greatly improved by the addition of Compound (I)-4.

It can also be seen that the effect of Compound (I)-4 becomes larger as the concentration of benzyl alcohol in a blix solution is higher.

EXAMPLE 2

By following the same procedure described in Example 1, experiments were performed with various kinds of 3-pyrazolidones in blix solutions and the results are shown in Table 2.

TABLE 2

| Concentration of Benzyl Alcohol (ml/l) | Compound (mg/l) | Maximum Density |
|---|---|---|
| 5.0 | None | 1.95 |
| 0 | (I)-4 206 | 2.50 |
| 5.0 | (I)-4 206 | 2.58 |
| 5.0 | (I)-1 161 | 2.57 |
| 5.0 | (I)-6 175 | 2.54 |
| 5.0 | (I)-7 175 | 2.53 |
| 5.0 | (I)-9 222 | 2.60 |
| 5.0 | (I)-23 190 | 2.54 |
| 5.0 | (I)-28 241 | 2.61 |

The results shown in Table 2 clearly show that almost the same effect, as in the case of using Compound (I)-4, is obtained when using other 3-pyrazolidone compounds.

EXAMPLE 3

By following the same procedure as in Example 1, the following five kinds of cyan couplers were used in Sample (A) and the maximum densities of the cyan dyes were measured.

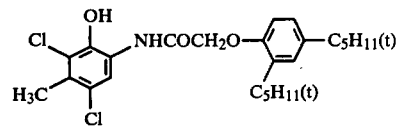

C-1

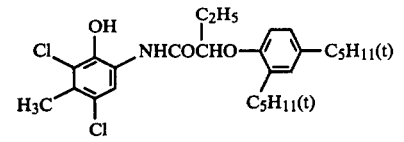

C-2

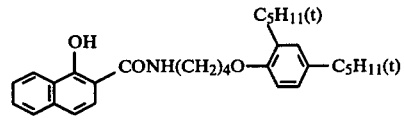

C-3

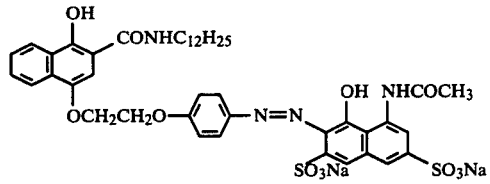

C-4

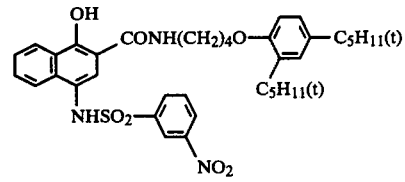

C-5

The results obtained are shown in the following table.

TABLE 3

| Concentration of Benzyl Alcohol (ml/l) | Cyan Coupler | Compound (I) (ml/l) | Maximum Density |
|---|---|---|---|
| 0 | C-1 | None | 2.22 |
| 0 | C-1 | (I)-4 309 | 2.52 |
| 5 | C-1 | None | 1.92 |
| 5 | C-1 | (I)-4 309 | 2.63 |
| 5 | C-2 | None | 1.90 |
| 5 | C-2 | (I)-4 309 | 2.60 |
| 5 | C-3 | None | 1.85 |
| 5 | C-3 | (I)-28 360 | 2.55 |
| 5 | C-4 | None | 1.98 |
| 5 | C-4 | (I)-28 360 | 2.59 |
| 5 | C-5 | None | 1.95 |
| 5 | C-5 | (I) 28 360 | 2.60 |

The results shown in Table 3 clearly indicate that the conversion of cyan dyes into leuco compounds can be prevented by utilizing the present invention.

While the invention has been described in detail and with reference to specific embodiments thereof, it will be apparent to one skilled in the art that various changes and modifications can be made therein without departing from the spirit and scope thereof.

What is claimed is:

1. In a method of developing, bleaching and fixing silver halide color photographic materials, the improved method which comprises using a bleach solution or a blix solution containing benzyl alcohol in an amount of 3.0 to 30 ml/l and at least one compound represented by the following general formula (I):

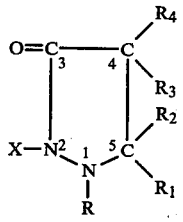

(I)

wherein X represents a hydrogen atom or an acetyl group; R represents an aryl group; and $R_1$, $R_2$, $R_3$ and $R_4$, which may be the same or different, each represents a hydrogen atoms, an alkyl group or an aryl group.

2. The method as claimed in claim 1, wherein the compound represented by the general formula (I) is present in an amount of from 0.1 to 5.0 g per l of the bleach solution or blix solution.

3. The method as claimed in claim 1, wherein the benzyl alcohol is present in the solution in an amount of from 3.0 to 10.0 ml per l of the solution.

4. The method as claimed in claim 1, wherein $R_1$, $R_2$, $R_3$ and $R_4$ are a hydrogen atom, an alkyl group containing 1 to 3 carbon atoms or a substituted alkyl group where the alkyl moiety contains 1 to 3 carbon atoms.

5. The method as claimed in claim 1, wherein $R_1$, $R_2$, $R_3$ and $R_4$ represent a hydrogen atom, a methyl group, a hydroxymethyl group or a hydroxyethyl group.

6. The method as claimed in claim 2, wherein the compound represented by the general formula (I) is present in an amount of from 0.1 to 1.0 g per l of the solution.

* * * * *